US006344265B1

(12) United States Patent
Blomstedt et al.

(10) Patent No.: US 6,344,265 B1
(45) Date of Patent: Feb. 5, 2002

(54) COATED CUTTING INSERT

(75) Inventors: Per Blomstedt, Uppsala; Mikael Lagerqvist, Upplands Väsby; Marian Mikus, Skärholmen, all of (SE)

(73) Assignee: Sandvik A.B., Sandviken (SE)

( * ) Notice: Subject to any disclaimer, the term of this patent is extended or adjusted under 35 U.S.C. 154(b) by 0 days.

(21) Appl. No.: 09/547,339

(22) Filed: Apr. 11, 2000

(30) Foreign Application Priority Data

Apr. 26, 1999 (SE) ..... 9901485

(51) Int. Cl.[7] ..... B32B 9/00

(52) U.S. Cl. ..... 428/216; 428/325; 428/336; 428/497; 428/698; 428/699; 428/700; 428/702; 407/119

(58) Field of Search ..... 428/325, 216, 428/356, 42, 472, 701, 702, 698, 195, 199, 697; 51/307, 309; 407/119

(56) References Cited

U.S. PATENT DOCUMENTS

| | | | |
|---|---|---|---|
| 4,843,039 A | 6/1989 | Akesson et al. | 501/87 |
| 5,654,035 A | 8/1997 | Ljungberg et al. | 427/255.3 |
| 5,718,948 A | 2/1998 | Ederyd et al. | 427/249 |
| 5,861,210 A | 1/1999 | Lenander et al. | 428/336 |
| 5,945,207 A | 8/1999 | Kutscher et al. | 428/216 |

FOREIGN PATENT DOCUMENTS

| | | |
|---|---|---|
| EP | 0 685 572 A2 | 12/1995 |
| EP | 0 736 615 A2 | 10/1996 |
| EP | 753603 | 1/1997 |
| WO | 98/02598 | 1/1998 |
| WO | WO 98/10119 | 3/1998 |

*Primary Examiner*—Archene Turner
(74) *Attorney, Agent, or Firm*—Burns, Doane, Swecker & Mathis, L.L.P.

(57) ABSTRACT

The present invention relates to a coated body such as a cutting tool insert comprising a wear resistant coating and a cemented carbide body particularly useful for the machining of cast iron parts by turning, milling or drilling at high speeds. The cemented carbide body consists of WC, 3.5–9 wt-% Co and <2 wt-% carbides of Ta, Ti and Nb. It has a core containing finely distributed eta phase islands and an intermediate zone 50–250 μm thick essentially free of eta phase and with nominal Co content whereby the binder phase in the intermediate zone is present as smaller original islands and larger islands transformed from original eta phase. These latter Co-islands therefore have a size and distribution essentially the same as that of the eta phase in the core. There may be present a thin surface zone free of eta phase with a Co content lower than the nominal Co-content.

7 Claims, 2 Drawing Sheets

A

F

COATED CUTTING INSERT

FIELD OF THE INVENTION

The present invention relates to a coated cemented carbide insert particularly useful as a cutting tool for the machining of cast iron at high speeds.

BACKGROUND OF THE INVENTION

Cast iron materials may be divided into two main categories, namely grey cast iron and nodular cast iron. From machinability point of view these two materials are quite different. There are also a number of other cast iron materials having intermediate machinability properties, such as the newly developed compact graphite iron.

Grey cast irons have graphite flakes well distributed in the microstructure and are comparatively easy to machine. These flakes form short chips and provide a lubricating effect in the cutting zone. At high cutting speeds the cemented carbide inserts used in cutting tools for machining are mainly subjected to abrasive and diffusional wear.

Nodular cast irons are long chipping materials and their greater deformation resistance leads to a higher temperature level in the cutting zone of the cutting tool insert. This gives rise to excessive wear due to plastic deformation of the cutting edge of the cutting insert by creep.

U.S. Pat. No. 5,945,207 discloses a coated cutting insert particularly useful for the machining of cast iron parts by turning. It is exemplary of cemented carbide based tools useful for such applications and is recommended for use at cutting speeds of 200–300 m/min and 150–200 m/min, respectively when turning grey cast iron and nodular cast iron at a feed of 0.4 mm/rev.

For the machining of cast iron at higher speeds, $Si_3N_4$ based ceramic tools are normally used. The recommended cutting speeds when using tools of this ceramic material, at the same feed as above, are 400–700 m/min for turning of grey cast iron and 200–300 m/min of nodular cast iron. However, such tools suffer from brittleness and are more expensive to produce than corresponding coated cemented carbide tools. Therefore, it would be more cost effective if cemented carbide inserts could be used for machining, turning or milling a cast iron components at higher speeds when compared to prior art. Further, the use of cemented carbide based inserts instead of ceramic inserts decreases the risk of premature rupture and accordingly increases the possibility to estimate a useful life of the inserts.

U.S. Pat. No. 4,843,039 teaches how to produce cemented carbide bodies suitable for chip forming machining having a core containing eta phase, $M_6C$ ($Co_3W_3C$) and/or $M_{12}C$ ($Co_6W_6C$) embedded in normal alpha (WC)+beta (Co binder phase), said core being surrounded by a surface zone containing alpha and beta phase. The surface zone is free of eta phase and has a lower binder phase content than the nominal content of binder phase in the sintered body. The inner part of the surface zone situated nearest to the core has a content of binder phase greater than the nominal content of binder phase in the sintered body. Thus, the cemented carbide body obtained has a surface zone with comparatively low cobalt content, i.e. having a high resistance to creep deformation, followed by a zone with high Co content having a high ductility.

SUMMARY OF THE INVENTION

It is an object of this invention to provide a coated cutting tool particularly useful for the machining of cast iron parts by turning, milling or drilling at high speeds.

In one aspect, the present invention provides an article comprising a wear resistant coating applied to a cemented carbide body wherein:

the cemented carbide body comprises WC with an average grain size of 0.5–4 μm, 3.5–9 wt-% Co and <2 wt % carbides of Ta, Ti and Nb, said body further comprising a core containing finely distributed eta phase islands with a size of 1–15 μm, the core containing 10–35 vol-% WC and Co binder phase, said body further comprising an intermediate zone 50–250 μm thick and is essentially free of eta phase and with nominal Co-content, said body further comprising a 0–25 μm thick surface zone free of eta phase with a Co content lower than the nominal Co-content of the body;

wherein the binder phase in the intermediate zone comprises a bimodal structure of smaller original eta phase islands and larger eta phase islands.

In another aspect, the present invention provides a method of making a coated cemented carbide body, the body comprising a cemented carbide of WC with an average grain size of 0.5–4 μm, 3.5–9 wt-% Co and <2 wt-% carbides of Ta, Ti and Nb and with a substoichiometric carbon content, the method comprising: sintering the body such that an eta phase containing structure is obtained in which the eta phase is finely distributed with a size of 1–15 μm and a content of 10 vol-% to 35 vol-%, and subjecting the cemented carbide body to a gentle recarburisation such that the eta phase in a 50–350 μm wide intermediate zone is transformed to WC+Co without essentially changing its Co-content.

DETAILED DESCRIPTION OF PREFERRED EMBODIMENTS

Figure 1:
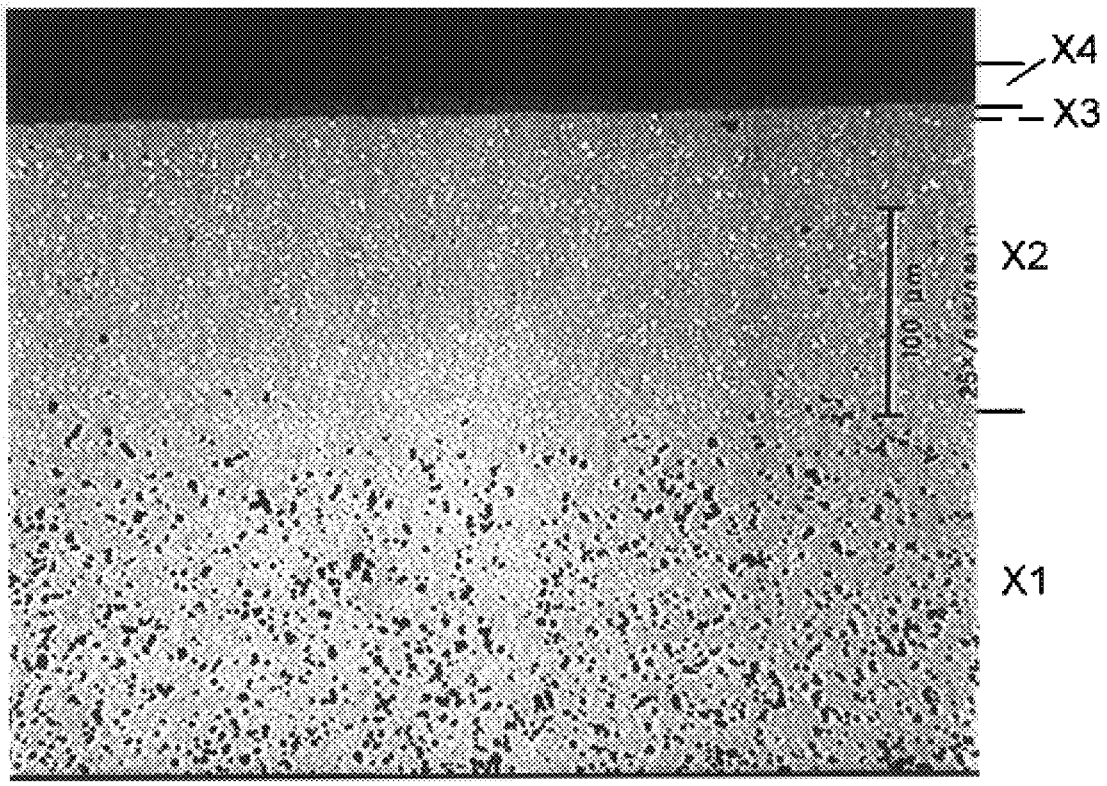
FIG. 1 is a micrograph at 40× magnification of the insert cross section showing the microstructural features of a coated insert according to the present invention.

FIG. 1 generally depicts:

X1 —center of the cemented carbide body containing WC, binder phase and eta phase ($M_6C$)

X2 —intermediate zone containing WC and binder phase

X3 —surface zone of the cemented carbide body containing WC and a low content of binder phase X4 —coating.

Figure 2:
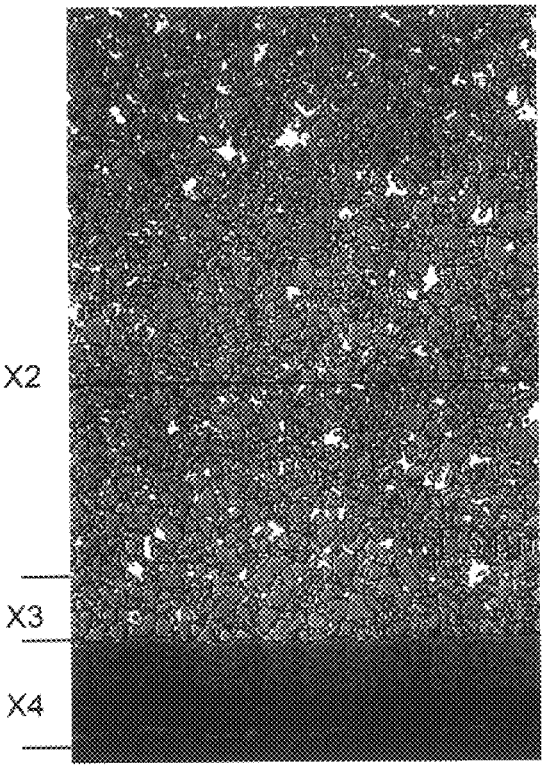
FIG. 2A is a micrograph taken at 1200× magnification showing the microstructure of an insert according to the present invention.
FIG. 2F is a micrograph of a cemented carbide microstructure having a stoichiometric carbon content according to the present invention.
Figure 2:
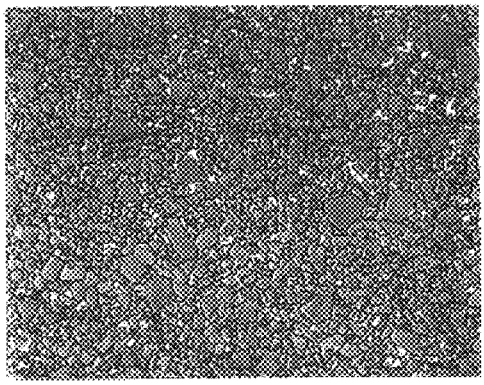

FIG. 2 generally depicts:

A: the microstructure of the intermediate zone (X2), the surface zone (X3) and the coating (X4) of an insert according to the present invention F: microstructure of the same cemented carbide as A with stoichiometric carbon content.

According to the invention there is provided a cutting tool insert comprising a wear resistant coating and a cemented carbide body. The cemented carbide body has a composition including 3.5–9, preferably 5–8 weight-% Co; less than 2, preferably less than 0.5, most preferably 0 weight-%, carbides of the metals Ti, Ta and/or Nb; and balance WC. The average grain size of the WC in as sintered state is 0.5–4 μm, preferably 1–3 μm. The body has a core containing eta phase, WC, Co binder phase and possibly gamma phase (cubic carbides); an intermediate zone essentially free of eta phase; and a surface zone free of eta phase. The eta phase in the core is finely distributed with a size of 1–15, preferably 3–10 μm and its content is at least 10 vol-% but at the most 35 vol-%. The amount of the eta phase in the core depends on the nominal Co content and at least 20%, and preferably 40–80%, of the nominal Co content should be present as Co binder phase, with the rest of Co in the form of the eta phase.

A surface zone less than 25 μm thick with Co content somewhat lower than the nominal Co-content may be present. The intermediate zone is 50–350 μm thick with a Co-content essentially equal to the nominal Co content. The binder phase in this zone has a bimodal structure comprising small size and large size Co islands. The large size Co islands are transformed from eta phase. The small size Co islands comprise islands which for the most part were present in the structure in the form of Co phase prior to the carburising treatment. The spatial distribution of the large Co islands is essentially the same as that of the eta phase in the core and they are often of an irregular shape with a maximum size somewhat smaller than that of the eta phase in the core.

In one preferred embodiment the wear resistant coating comprises a layer of $TiC_xN_y$ where x+y=1, x>0.3 and y>0.3, with a thickness of 5–10 μm with columnar grains having a diameter of a size <2 μm.

In another preferred embodiment the wear resistant coating comprises a layer of smooth $\alpha$-$Al_2O_3$ and/or $\kappa$-$Al_2O_3$having a grain size of 0.5–2 μm with a thickness of 3–6 μm.

In another preferred embodiment the wear resistant coating comprises a first, innermost, layer of $TiC_xN_yO_z$ with x+y+z=1 and y>x and z<0.1 with a thickness of 0.1–2 μm, and with equiaxed grains having a size <0.5 μm;

a second layer of $TiC_xN_y$ where x+y=1, x>0.3 and y>0.3, with a thickness of 5–10 μm, and with columnar grains having a diameter of a size <2 μm;

a third layer of $TiC_xN_yO_z$ where x+y+z=1, z<0.5 and x>y with a thickness of 0.1–2 μm and with equiaxed or needle-like grains having a size <0.5 μm;

a fourth layer of smooth $\alpha$-$Al_2O_3$ having a grain size of 0.5–2 μm with a thickness of 3–6 μm; and an outermost layer of $TiC_xN_yO_z$ where x+y+z=1, z <0.05 with a thickness of 0.5–3 μm and a grain size <1 μm. Preferably, this outermost layer is removed from at least the edge line so that the $Al_2O_3$ layer is on top along the cutting edge line and the outer layer of $TiC_xN_yO_z$ is the top layer on the clearance side.

According to the method of the present invention a cemented carbide body with a composition according to above with substoichiometric carbon content is sintered such that an eta phase containing structure is obtained in which the eta phase is finely distributed with a size of 1–15, preferably 3–10 μm and a content of at least 10 vol-% but at the most 35 vol-%. The amount of the eta phase in the core depends on the nominal Co content and at least 20%, preferably 40–80%, of the nominal Co content should be present as Co binder phase and the rest of the Co in the form of eta phase. If the carbon content is too close to the stoichiometric carbon content, small amounts of excessively coarse eta phase are formed. If the carbon content is too low, too much eta phase will be formed. It is within the purview of the skilled artisan to determine by experiments the conditions necessary to obtain the desired microstructure using his equipment.

After sintering, the cemented carbide is subjected to a gentle recarburisation such that the eta phase in the intermediate and the surface zone is transformed to WC+Co while maintaining, except for the surface zone, essentially the same Co content as that in the eta phase comprising core. The recarburisation is preferably performed at 1250° C. to 1350° C. for 0.5–3 h in a carburising atmosphere such as an $H_2$+$CH_4$-mixture. However, the exact conditions depend strongly upon the equipment used, particularly the carbon potential of the furnace. It is within the purview of the skilled artisan to determine by experiments the conditions necessary to obtain the desired microstructure using his equipment.

The body obtained is coated with wear resistant layers using conventional PVD, CVD or MTCVD-methods.

The reason for the observed improvement of inserts according to the invention is probably a unique Co distribution causing increased toughness without loss of plastic deformation resistance, so that even at very large feeds no fracture is obtained. A cemented carbide with a Co-distribution comprising large Co islands can be obtained using coarse grained WC with a grain size between 4 and 10 μm (inclusive of the limits). However, such cemented carbide will exhibit a high toughness but inadequate resistance against plastic deformation during cutting operations at high speed machining. It is believed that the WC skeleton present between large Co islands in inserts according to invention is stronger than that of the prior art. Thus, inserts according to the invention have an improved toughness with adequate resistance to plastic deformation during high speed machining.

EXAMPLE 1

Coated inserts were made as follows:

A. Cemented carbide cutting tool insert blanks of style CNMA120412-KR for turning of cast iron were pressed from a WC-6% Co powder with 0.18% substoichiometric carbon content and having an average WC grain size of about 2.5 μm. The pressed blanks were then standard sintered at 1450° C. In vacuum with a holding time of 1 hour at the sintering temperature. After conventional surface grinding, edge rounding and cleaning treatments, the inserts were resintered under gentle carburising conditions at 1330° C. for 1 hour. The inserts had a micro structure consisting of a core containing about 20 vol-% eta phase with a size of up to 7 μm embedded in the normal WC+Co-structure, followed by an intermediate zone 150 μm thick having a nominal Co-content and finally a 10 μm surface zone with a Co-content of about 3 wt-%, (see FIG. 1 and FIG. 2 - A). The binder phase in the intermediate zone had a bimodal structure comprising small sized islands (up to 1.5 μm) and large sized irregular Co islands (up to 5 μm).

The treated inserts were then coated with a 0.5 μm equiaxed $TiC_{0.1}N_{0.9}$layer having an average grain size of 0.2 μm, followed by a 8.0 μm thick $TiC_{0.55}N_{0.45}$ layer with columnar grains having an average grain size of 2.5 μm. This layer was applied using MT-CVD technique (process temperature 850° C. and $CH_3CN$ as the carbon/nitrogen source). In subsequent process steps during the same coating cycle, a 1 μm thick layer of $TiC_{0.6}N_{0.2}O_{0.2}$ with equiaxed grains and an average grain size of 0.2 μm was deposited followed by a 5.0 μm thick layer of (012)-textured $\alpha$-$Al_2O_3$, with average grain size of about 1.2 μm. The layer was deposited according to conditions given in U.S. Pat. No. 5,654,035. On top of the $\alpha$-$Al_2O_3$ layer, TiN/TiC/TiN/TiC/TiN was deposited in a multilayer structure with a total coating thickness of 1.5 μm, the average grain size was <0.3 μm in each individual layer. Finally, the inserts were subjected to a rotary brushing treatment in which the cutting edge lines were smoothed with a nylon brush containing 320 mesh abrasive SiC particles. By this treatment the outer TiN/TiC multilayer was removed along the cutting edge line.

B. Inserts of style CNMA120412-KR with the composition 6.0 weight-% Co and balance WC were sintered in a conventional way at 1410° C. and cooled down to 1200° C. In 0.6 bar $H_2$ giving inserts with a WC grain size of about 1.3 μm, a binder phase highly alloyed with W, and a Co content on the surface corresponding to 6 weight-%. The inserts were then ground, edge roundness treated, cleaned, coated and brushed in the same way as the inserts A. Type B inserts correspond to WO 98/10119 or equivalent U.S. Pat. No. 5,945,207.

C. Inserts of style CNMA120412-KR with the composition 3.7 weight-% Co, 2.0 weight-% cubic carbides and balance WC were sintered in a conventional way at 1520° C. giving a WC grain size of about 1.0 μm. The sintered insert blanks were then subjected to identical processes and treatments as inserts B.

D. Inserts identical to insert B with the exception that the thicknesses of the TiCN and $Al_2O_3$ layers in the coating were 4.0 and 10.0 μm respectively.

E. $Si_3N_4$ ceramic inserts of a commercial grade (Sandvik CC690) and of a style similar to CNMA120412-KR were provided. In order to strengthen the cutting edge to avoid premature rupture, a T02520 reinforcement chamfer was ground along the entire edge line.

F. Inserts of style CNMA120412-KR with the composition 6.0 weight-% Co and balance WC were sintered in a conventional way at 1410° C. and cooled down to 1200° C. In 0.6 bar $H_2$ giving inserts with a WC grain size of about 2.6 μm and a binder phase highly alloyed with W and a Co content on the surface corresponding to 6 weight-%. The inserts were then ground, edge roundness treated, cleaned, coated and brushed in the same way as the inserts A.

The inserts were tested in a longitudinal turning operation using coolant. The workpiece consisted of discs of nodular cast iron, SS0727, which were pressed together in order to provide a large amount of cast iron skin, i.e. abrasive wear, and a certain degree of intermittence during each cut. Cutting speed was 400 m/min, feed 0.40 mm/rev and cutting depth 2.0 mm. Three edges per type were tested and the life was determined by any of the following criteria:

a flank wear (VB) exceeding 0.50 mm, rupture, edge fracture, excessive wear in the minor cutting edge, or excessive wear at the depth of cut.

The result was as follows:

| | Life, number of discs cut | | |
|---|---|---|---|
| Insert | Min. | Mean | Max. |
| A, (invention) | 12.0 | 12.0 | 12.0 |
| B | 6.0 | 6.8 | 7.4 |
| C | 4.7 | 5.9 | 6.9 |
| D | 1.0 | 4.8 | 7.5 |
| E | 3.0 | 5.0 | 6.0 |
| F | 5.0 | 6.0 | 7.0 |

In inserts B, C and D—prior art edge fractures occurred in 10–30% of the tested edges. In insert F, plastic deformation of the edge and flaking occurred.

In a next test, the cutting speed was increased to 750 m/min, other conditions kept constant. The following result was obtained:

| | Tool life, number of cuts | | |
|---|---|---|---|
| Insert | Min. | Mean value | Max. |
| A (Invention) | 2.1 | 2.7 | 3.0 |
| B | 0.8 | 2.4 | 3.0 |
| E | 1.5 | 2.0 | 2.5 |
| F | 1.0 | 1.5 | 2.0 |

The continuous cut tests show that the inserts A have better performance than the prior art in high productivity machining of nodular cast iron.

Following these tests, interrupted cutting was tried as well. The same cutting conditions were used with cutting speed 650 rpm and feed 0.30mm/rev, The tool life criterion was fracture of the insert.

| | Tool life, number of cuts | | |
|---|---|---|---|
| Insert | Min. | Mean value | Max. |
| A (Invention) | 5.0 | 5.5 | 6.0 |
| B | 4.0 | 4.0 | 4.0 |
| E | 3.0 | 3.5 | 4.0 |

EXAMPLE 2

For further testing the following inserts were prepared and compared to inserts A of Example 1.

G. Inserts of style CNMA120412 having a conventional substrate of WC-6% Co by weight and a WC grain size of 1.0 μm. The coating was similar to the one in type A but the $\alpha$-$Al_2O_3$ layer was somewhat thinner, 1.2 μm.

H. Inserts of style CNMA120412 having the same substrate as type B, (see Example 1) and a coating of a 4 μm thick layer of TiAlN deposited by PVD.

I. Inserts of style CNMA120412 having the same substrate as type G and a coating of a 4 μm thick layer of TiCN deposited by PVD.

J. Cemented carbide cutting tool inserts of style CNMA120412 having the same substrate as type G and a coating of a 4 μm thick layer of TiCN/TiN deposited by PVD.

The test conditions were:

Workpiece: 100% pearlitic compact graphite iron (CGI), cast tube blank $D_y$=145 mm and $D_i$=98 mm.

Cutting speed: 300 m/min

Feed: 0.20 mm/rev.

Cutting depth: 0.5 mm

Tool cutting edge angle: 95°

No coolant

The life of the inserts was determined as the number of cuts until flank wear (VB) reached a depth of 0.3 mm. The result so obtained was as follows:

| Insert | Tool life, (number of cuts) |
|---|---|
| A, (invention) | 160 |
| G | 110 |
| H | 110 |
| I | 60 |
| J | 30 |

EXAMPLE 3

By using optical image analysis, the microstructure within the intermediate zone in inserts A was compared to that of similar inserts produced in a conventional way, insert F. The latter inserts consisted of WC—Co cemented carbide having essentially the same WC grain size as insert A, the same nominal Co content as insert A but a stoichiometric carbon content resulting in no eta phase presence. At a magnification of 2000× an area of the size 50x50 μm within the intermediate zone in insert A was analysed using a Quantimet 570, Cambridge Instruments, and compared to the same area within the insert F. The results of the analysis were obtained as an area fraction distribution within 20% steps, between 0 and 100% (inclusive of the limits), as a function of area size. After recalculating the latter areas to a characteristic size corresponding to the diameter of a circle having the same area, the distributions were as follows:

| | (Co-island size μm) | |
|---|---|---|
| Area fraction (%) | A, invention | F, prior art |
| 0–20 | 0–0.5 | 0–0.35 |
| 20–40 | 0.5–0.8 | 0.35–0.5 |
| 40–60 | 0.8–1.6 | 0.5–0.75 |
| 60–80 | 1.6–2.3 | 0.75–1.0 |
| 80–100 | 2.3–5.0 | 1.0–2.0 |

The table shows that insert A, according to invention has much wider Co islands size distribution than that in insert F, prior art.

The foregoing has described the principles, preferred embodiments and modes of operation of the present invention. However, the invention should not be construed as being limited to the particular embodiments discussed. Thus the above-described embodiments should be regarded as illustrative rather than restrictive, and it should be appreciated that variations may be made in those embodiments by workers skilled in the art without departing from the scope of the present invention as defined by the following claims.

We claim:

1. An article comprising a wear resistant coating applied to a cemented carbide body wherein:

the cemented carbide body comprises WC with an average grain size of 0.5–4 μm, 3.5–9 wt-% Co and <2 wt % carbides of Ta, Ti and Nb, said body further comprising a core containing finely distributed eta phase islands with a size of 1–15 μm, the core containing 10–35 vol-% WC and Co binder phase, said body further comprising an intermediate zone 50–250 μm thick and is essentially free of eta phase and with nominal Co-content, said body further comprising a 0–25 μm thick surface zone free of eta phase with a Co content lower than the nominal Co-content of the body;

wherein the binder phase in the intermediate zone comprises a bimodal structure of smaller original binder phase islands and larger binder phase islands.

2. The article of claim 1, wherein the core further comprises gamma phase.

3. The article of claim 1, wherein the coating comprises a layer of $TiC_xN_y$ where x+y=1, x>0.3 and y>0.3, with a thickness of 5–10 μm with columnar grains having a diameter of a size <2 μm.

4. The article of claim 1, wherein the coating comprises at least one layer chosen from a smooth $\alpha$x-$Al_2O_3$ and $\kappa$-$Al_2O_3$ the layer having a grain size of 0.5–2 μm with a thickness of 3–6 μm.

5. The article of claim 1, wherein the coating comprises a first, innermost, layer of $TiC_xN_yO_z$ with x+y+z=1 and y>x and z<0.1 with a thickness of 0.1–2 μm, and with equiaxed grains having a size <0.5 μm;

a second layer of $TiC_xN_y$ where x+y=1, x>0.3 and y>0.3, with a thickness of 5–10 μm with columnar grains having a diameter of a size <2 μm;

a third layer of $TiC_xN_{y\ Oz}$ where x+y+z=1, z<0.5 and x>y with a thickness of 0.1–2 μm and with equiaxed or needle-like grains having a size <0.5 μm;

a fourth layer of smooth $\alpha$-$Al_2O_3$ having a grain size of 0.5–2 μm with a thickness of 3–6 μm; and finally an outermost layer of $TiC_xN_yO_z$ where x+y+z=1, z<0.05 with a thickness of 0.5–3 μm and a grain size <1 μm.

6. The article of claim 5, wherein the article comprises a cutting tool insert having at least one cutting edge and a clearance side.

7. The insert of claim 6, wherein the outermost layer is removed along the cutting edge so that the $Al_2O_3$ layer is exposed along the cutting edge, and the outer layer of $TiC_xN_yO_z$ is exposed on the clearance side.

* * * * *